US009032550B2

(12) United States Patent
Lambertz

(10) Patent No.: US 9,032,550 B2
(45) Date of Patent: May 19, 2015

(54) ITEM OF CLOTHING

(75) Inventor: Bodo W. Lambertz, Pfäffikon (CH)

(73) Assignee: X-Technologies Swiss GmbH, Wollerau (CH)

( * ) Notice: Subject to any disclaimer, the term of this patent is extended or adjusted under 35 U.S.C. 154(b) by 565 days.

(21) Appl. No.: 12/450,535

(22) PCT Filed: Sep. 6, 2007

(86) PCT No.: PCT/DE2007/001613

§ 371 (c)(1),
(2), (4) Date: Sep. 29, 2009

(87) PCT Pub. No.: WO2008/122254

PCT Pub. Date: Oct. 16, 2008

(65) Prior Publication Data

US 2010/0058509 A1 Mar. 11, 2010

(30) Foreign Application Priority Data

Apr. 10, 2007 (DE) ..... 20 2007 005 259 U

(51) Int. Cl.
*A41D 13/00* (2006.01)
*A41D 31/00* (2006.01)

(52) U.S. Cl.
CPC ..... *A41D 31/0038* (2013.01); *A41D 2400/60* (2013.01); *A41D 2500/10* (2013.01)

(58) Field of Classification Search
USPC ..... 2/69, 81, 167, 87, 90, 169; 28/169
See application file for complete search history.

(56) References Cited

U.S. PATENT DOCUMENTS

| | | | | | |
|---|---|---|---|---|---|
| 3,591,400 | A * | 7/1971 | Palmquist | 442/380 |
| 4,664,158 | A * | 5/1987 | Sands | 139/422 |
| 4,994,317 | A * | 2/1991 | Dugan et al. | 442/72 |
| 5,778,702 | A * | 7/1998 | Wrightenberry | 66/178 R |
| 5,787,503 | A * | 8/1998 | Murphy, III | 2/90 |
| 5,965,223 | A * | 10/1999 | Andrews et al. | 428/34.5 |
| 6,499,320 | B1 * | 12/2002 | Bernhardt | 66/178 R |
| 2004/0210988 | A1 * | 10/2004 | Lambertz | 2/239 |

* cited by examiner

*Primary Examiner* — Richale Quinn
(74) *Attorney, Agent, or Firm* — Olson & Cepuritis, Ltd.

(57) ABSTRACT

The invention relates to an item of clothing, in particular to be worn during sports such as jogging, skating, cycling or similar. Said item of clothing is made of at least one yarn (3) that comprises a heat-reflecting covering (5).

19 Claims, 2 Drawing Sheets

ITEM OF CLOTHING

Figure 1:
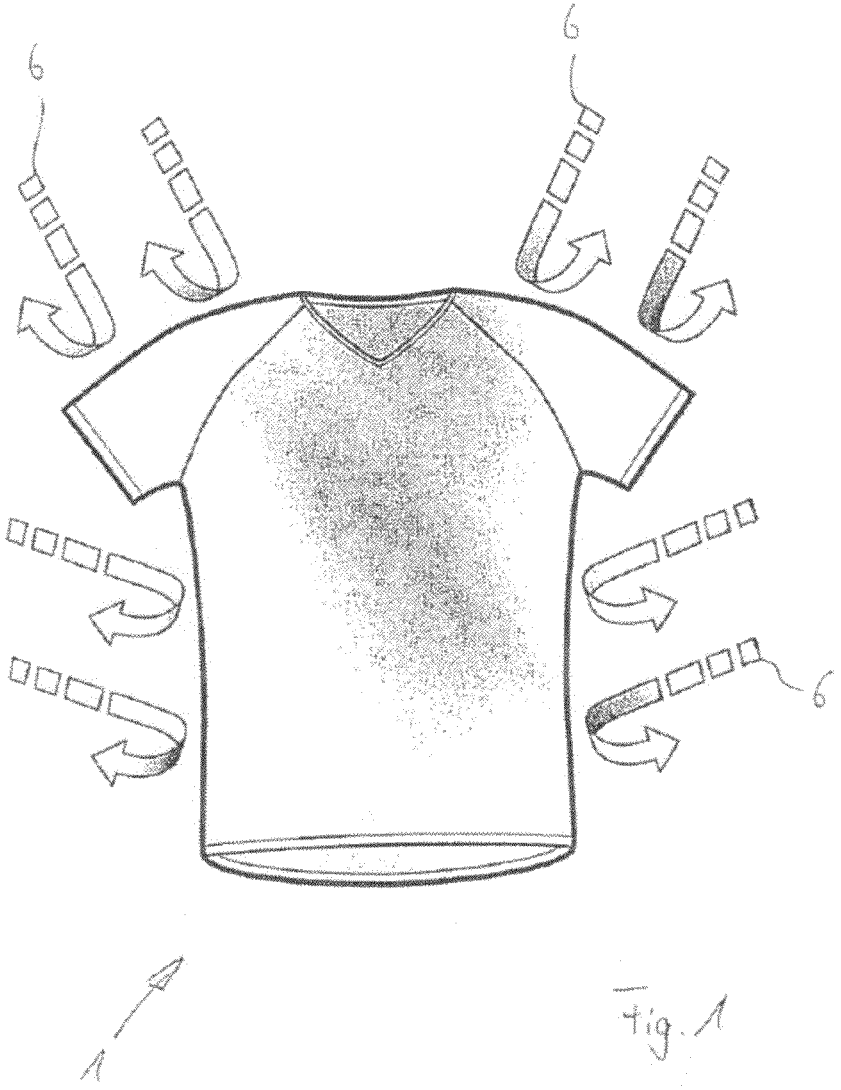

This application is the National Stage of International Application No. PCT/DE2007/001613 filed Sep. 6, 2007.

The invention relates to an item of clothing, in particular to be worn during athletic activities such as jogging, skating, cycling or the like. Said item of clothing is made of at least one yarn.

A variety of requirements are made of clothing items for athletic activities. First, they should have a relatively low weight to prevent any additional burden on the athlete due to weight; secondly, the clothing should be based on the function, i.e., directed at the specific types of athletic activities. Therefore, the clothing is provided with padding, stretching elements or the like which ensure optimum functional reliability aimed at the respective type of athletic activity (cf. DE 79 14 614 U1, for example). Furthermore, clothing for athletic activities should achieve a climate regulating effect. Vents and aerating devices on clothing items are known for this purpose (cf. U.S. Pat. No. 6,263,510 B1, for example). Targeted dissipation or conduction of heat within clothing at certain locations to improve the climate properties of the clothing is also known.

One factor which has previously been disregarded in the design of clothing items for athletic activities is the air surrounding the athlete outdoors. In endurance types of sports, in particular such as jogging, skating, cycling or the like, the athlete is in some cases exposed to much warmer air in the summer. The hot air is due to the sunlight or solar radiation. However, sunlight also causes heating of the road surface, building walls, etc. Therefore, the air is additionally heated by the radiant heat of the road covering or building walls.

The hot air acts directly on the athlete's body because the known clothing items are not designed for reflecting ambient heat and therefore the hot air comes in direct contact with the athlete's skin. This results in a reduction of the athlete's performance ability because his body is exposed not only to the additional heat due to his own athletic activity but also to the heat of the ambient air. This results in an increase in body temperature. Since the human body has a comfort temperature of 37° C., which at the same time also represents the temperature of maximum performance ability, an increase in body temperature usually leads to a decline in performance. Keeping the hot ambient air away from the body could thus result in an increased performance in endurance types of athletic activity.

It is known that clothing items can be produced to allow heat, e.g., due to fire to be kept away from the body and which therefore have a high thermal stability and thus protect the person wearing such an item of clothing from high temperatures. This is the case in particular with clothing items for people who work on blast furnaces or for firemen (cf. U.S. Pat. No. 4,034,417, for example). These clothing items are usually made of several layers, at least one layer having a high thermal stability. At the same time, these clothing items are usually water repellant. Synthetic fibers are used here but other sparingly flammable materials using ceramic materials, glass or the like may also be used (cf. DD 247 637 A1, for example). Although the known clothing items have a high thermal stability and/or a heat insulating effect, they are not suitable for athletic activities, in particular endurance types of sports such as jogging, skating, cycling and the like because the clothing items made of the known materials are heavy and allow only little freedom of movement.

Therefore an object of the present invention is to create an item of clothing which will result in an increase in performance by keeping the hot ambient air away from the body in athletic activities. According to the present invention, this object is achieved by the fact that the yarn has a coating which is heat reflective.

An item of clothing, in particular for use in athletic activities, is created with the present invention, allowing the hot ambient air to be kept away from the body. By providing a second yarn which has a heat-reflecting coating, it is possible to deflect the hot air toward the outside, i.e., away from the body, so the hot air is kept away from the body. Consequently, the athlete's skin is not additionally exposed to the heat of the ambient air in addition to the increased heat production due to the athlete's own exertion, so an additional increase in performance can be achieved.

In a further embodiment of the invention, the coating is made of noble metal. Noble metals have proven to be suitable for reflecting heat especially in testing. Furthermore, noble metals offer the advantage that they also allow reflection of sunlight so an improvement in climate conditions around the athlete is also achieved in this way.

Coating made of gold is advantageous. In testing the heat-reflective coating, the best results were achieved when using gold.

In a further embodiment of the invention, another yarn which is knit with the first yarn is provided. A multilayer clothing item is created in this way, so that through the choice of the additional yarn, a further targeted adjustment of the respective demands is possible.

The additional yarn preferably faces the skin and the first yarn faces away from the skin. This embodiment ensures that the heat-reflecting and light-reflecting yarn is provided on the outside to fulfill its task.

In one embodiment of the invention, the first yarn consists of polyamide [nylon]. Polyamide avoids uptake of moisture in the form of perspiration which occurs in sports so that the clothing item itself does not become fully saturated with the moisture and thereby increase its weight. Use of polyamide instead results in the sweat being distributed uniformly over the surface of the skin. Due to the large area of distribution there is a cooling effect and the perspiration dries more rapidly which also results in an increase in performance.

Other embodiments and further embodiments of the present invention are characterized in the other dependent claims. An exemplary embodiment of the invention is described in detail below and is illustrated in the drawing, in which FIG. 1 shows a schematic diagram of an item of clothing with heat acting on the clothing item and reflected by it, and FIG. 2 shows a detail of a schematic diagram of a clothing item of two yarns worked together.

Figure 2:
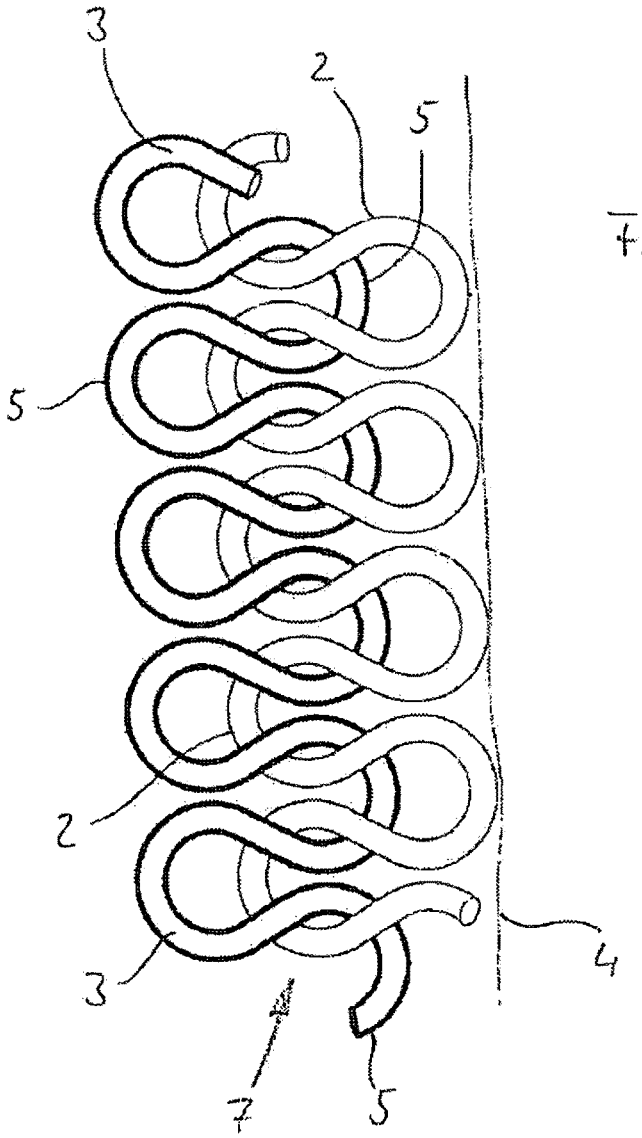

In the case of the item of clothing selected as the exemplary embodiment according to FIG. 1, it is a short-sleeved shirt 1, which is suitable for use in athletic activities. It is made of a yarn 3 which has a coating 5 that is heat reflective. In the exemplary embodiment according to FIG. 2, the clothing item 1 is manufactured from two yarns 2, 3 which are worked together. "Worked" in the sense of the present invention may mean that the yarns 2 and 3 are woven together or also that they are knit together. The woven material offers a high strength, whereas the knit material offers a very high elasticity. The yarn 2 is facing toward the skin, which is labeled as 4. The yarn 3 is facing away from the skin 4.

The yarn 2 in the exemplary embodiment consists of polyamide. Polyamides are polymers which usually include synthetics, e.g., thermoplastic synthetics that can be used industrially. The polyamides used here are both fibrous and nonfibrous polyamides. The polyamide used here is in contact with the skin, as shown by the schematic diagram in FIG. 2. It does not absorb moisture and therefore does not absorb perspiration. In athletic activity, this therefore prevents the clothing item from increasing in weight over a period of time due to possible uptake of perspiration, which would result in an increased burden for the athlete. On the contrary, the yarn 2 made of polyamide causes a better distribution of perspiration on the skin. This therefore creates a larger surface area for evaporation so that the perspiration can rapidly evaporate from the skin. At the same time, this creates a large area for the development of evaporative cooling, which has a cooling effect and leads to a reduction in body temperature, so the athlete's performance level is increased. In a modification of this exemplary embodiment, it is also possible to use polyester instead of polyamides for the yarn 2. On the other hand, in a modification of the exemplary embodiment, the yarns that are knit together can be subsequently provided with a coating on the side (inside) facing toward the skin in order to achieve certain effects, e.g., antifungal or fungicidal effects or antibacterial effects.

The yarn 3 in this exemplary embodiment is also made of polyamide. However, other materials may also be used for the yarn 3. The yarn 3 has a coating 5, which is heat reflecting. The coating 5 in the exemplary embodiment consists of noble metal, namely, gold in the present case. The use of other noble metals such as silver is also possible. The coating 5 may also be formed by applied paints or enamels or lacquers. The coating 5 causes reflection of incident heat and, depending on the type of coating 5, also causes reflection of incident sunlight. The yarn 3 acts like a mirror in a figurative sense because of the coating 5 applied to it. Heat or incidental sunlight acting on the clothing item 1 from the outside is reflected, as illustrated in FIG. 1 by the arrows 6 representing the incidental heat. With the noble metals, the reflection is caused by the shiny surface. With paints and varnishes, this, effect is achieved by the pigmentation. An approximately airtight and/or thermally tight and closed surface of the clothing item 1 can be achieved by a relatively dense mesh of the yarn 3.

In a modification of the exemplary embodiment, there is also the possibility of using additional layers of yarns so that a three-layer or four-layer woven fabric, for example, may also be produced. With the multilayer design of the woven fabric, a dividing layer 7 is also created between the layer facing toward the skin 4 (the yarn 2 in the embodiment according to FIG. 2) and the layer facing away from the skin 4 (the yarn 3 in the embodiment according to FIG. 2). In the exemplary embodiment, this dividing layer is formed by the mixed area of yarns 2 and 3. In the three-layer or four-layer design, the dividing layer is formed by the yarns arranged between the yarns 2 and 3. In high heat and/or with athletic activity, the moisture secreted in the form of perspiration collects in the dividing layer 7. The evaporative area is therefore greatly enlarged, so that more evaporative cooling can be achieved. This further improves the climatization effect.

According to the present invention, it is necessary only for the heat-reflecting layer 5 to form the layer facing away from the skin in order to allow reflection of heat and light and thereby achieve the effects described above. A definite improvement in the performance of the athlete at high temperatures or under high incidental light conditions is possible with the inventive clothing item because the body is not burdened by the additional hot ambient air but instead this is reflected by the coated yarn. At the same time, perspiration is distributed over a large area on the side facing toward the skin, in particular in the case of a multilayer design of the woven fabric, so that the evaporative cooling required for optimal cooling performance of the body can be achieved over a large area.

The invention claimed is:

1. A clothing item adapted to be worn on a body of a user during an athletic activity, such as jogging, skating, cycling or the like, comprising a fabric constructed from a first yarn and a coated yarn, said first yarn and said coated yarn being worked together as a woven or knitted fabric, the first yarn being configured to face skin of the user when the clothing item is worn, the first yarn consisting of at least one material selected from the group consisting of a polyamide and a polyester, and the coated yarn being configured to face away from the skin of the user when the clothing item is worn, the coated yarn consisting of a second yarn comprising a noble metal-containing coating on the surface of the second yarn in direct contact therewith, the coating being heat reflective to keep hot ambient air away from the body of the user in athletic activities, wherein a space is defined between the first yarn and the coated yarn in the fabric, said space collecting moisture secreted from the body of the user during athletic activity.

2. The clothing item according to claim 1, characterized in that the coating comprises gold.

3. The clothing item according to claim 1, characterized in that the coating comprises silver.

4. The clothing item according to claim 1, characterized in that the coating is formed by a lacquer.

5. The clothing item according to claim 1, characterized in that the coating is formed by a paint.

6. A clothing item according to claim 1, wherein the coating is light reflective.

7. The clothing item of claim 1 wherein the fabric is a knitted fabric.

8. A clothing item adapted to be worn by a person in contact with skin of the person for use in an athletic activity, the item of clothing comprising a woven or knitted fabric constructed from (a) a first yarn consisting of a polyamide yarn oriented in the fabric to contact the skin when the clothing item is worn, and (b) a coated yarn worked together with the first yarn, the coated yarn being oriented in the fabric to face away from the skin when the item of clothing is worn, the coated yarn consisting of a second yarn comprising a noble metal-containing coating on the surface thereof and in direct contact with the surface, the coating being heat reflective to keep hot ambient air away from the body of the person to enhance performance during athletic activity, wherein a space is defined between the first yarn and the coated yarn in the fabric, said space collecting moisture secreted from the body of the user during athletic activity.

9. The clothing item of claim 8, wherein the noble metal comprises gold.

10. The clothing item of claim 8, wherein the noble metal comprises silver.

11. The clothing item of claim 8, wherein the coating is formed by a lacquer.

12. The clothing item of claim 8, wherein the coating is formed by a paint.

13. The clothing item of claim 8, wherein the coating is light reflective.

14. A clothing item adapted to be worn by a person in contact with skin of the person for use in an athletic activity, the item of clothing comprising a woven or knitted fabric constructed from (a) a first yarn consisting of a polyester yarn oriented in the fabric to contact the skin when the clothing item is worn, and (b) a coated yarn worked together with the first yarn, the coated yarn being oriented in the fabric to face away from the skin when the item of clothing is worn, the coated yarn consisting of a second yarn comprising a noble metal-containing coating on the surface thereof and in direct contact with the surface, the coating being heat reflective to keep hot ambient air away from the body of the person to enhance performance during athletic activity, wherein a space is defined between the first yarn and the coated yarn in the fabric, said space collecting moisture secreted from the body of the user during athletic activity.

15. The clothing item of claim 14, wherein the noble metal comprises gold.

16. The clothing item of claim 14, wherein the noble metal comprises silver.

17. The clothing item of claim 14, wherein the coating is formed by a lacquer.

18. The clothing item of claim 14, wherein the coating is formed by a paint.

19. The clothing item of claim 14, wherein the coating is light reflective.

* * * * *